US007716758B2

(12) United States Patent
De Kruijf

(10) Patent No.: US 7,716,758 B2
(45) Date of Patent: May 18, 2010

(54) APPARATUS, BED AND METHOD FOR DISPLACING A RECUMBENT PERSON TO A SITTING POSITION

(75) Inventor: Wilhelmus Petrus Johannes De Kruijf, Enschede (NL)

(73) Assignee: Indes Holding B.V., Enschede (NL)

( * ) Notice: Subject to any disclaimer, the term of this patent is extended or adjusted under 35 U.S.C. 154(b) by 440 days.

(21) Appl. No.: 10/574,823

(22) PCT Filed: Oct. 1, 2004

(86) PCT No.: PCT/NL2004/000684

§ 371 (c)(1),
(2), (4) Date: Nov. 29, 2006

(87) PCT Pub. No.: WO2005/032445

PCT Pub. Date: Apr. 14, 2005

(65) Prior Publication Data

US 2007/0079440 A1 Apr. 12, 2007

(30) Foreign Application Priority Data

Oct. 6, 2003 (NL) ..... 1024459

(51) Int. Cl.
*A61G 7/10* (2006.01)
*A61G 7/053* (2006.01)

(52) U.S. Cl. ..... 5/81.1 R; 5/600

(58) Field of Classification Search ..... 5/81.1 R, 5/83.1, 85.1, 600, 662
See application file for complete search history.

(56) References Cited

U.S. PATENT DOCUMENTS

| | | | | |
|---|---|---|---|---|
| 5,375,277 | A | 12/1994 | Carr et al. | |
| 5,916,085 | A | 6/1999 | Wells | |
| 6,185,761 | B1 | 2/2001 | Chapman et al. | |
| 6,349,433 | B1 * | 2/2002 | Bouhuijs | 5/81.1 R |
| 2004/0019967 | A1 * | 2/2004 | Gant | 5/81.1 R |

FOREIGN PATENT DOCUMENTS

| | | |
|---|---|---|
| GB | 2 264 048 A | 8/1993 |
| WO | WO 97/10792 | 3/1997 |

* cited by examiner

*Primary Examiner*—Alexander Grosz
(74) *Attorney, Agent, or Firm*—The Webb Law Firm

(57) ABSTRACT

The invention relates to an apparatus for displacing a person from a lateral incumbent position to a sitting position and vice versa, comprising: engaging means for engaging on the person. The invention relates to a bed provided with such an apparatus. The invention further relates to a method for displacing a person from a lateral recumbent position to a sitting position using such an apparatus.

15 Claims, 3 Drawing Sheets

APPARATUS, BED AND METHOD FOR DISPLACING A RECUMBENT PERSON TO A SITTING POSITION

BACKGROUND OF THE INVENTION

1) Field of the Invention

The invention relates to an apparatus for displacing a person from a lateral recumbent position to a sitting position and vice versa, comprising: engaging means for engaging on the person, the engaging means being rotatable about a substantially horizontal axis such that, during rotation of the engaging means in a situation engaging on the person, the person undergoes a rotation about a substantially sagittal axis of the person from the lateral recumbent position to a sitting position and vice versa. The invention also relates to a bed provided with such an apparatus. The invention further relates to a method for displacing a person from a lateral recumbent position to a sitting position, and vice versa, using such an apparatus.

2) Description of the Prior Art

For many older people and semi-invalids it is generally difficult to move unassisted from a recumbent position in bed to a sitting position. Displacing a person between a lateral recumbent position and a sitting position can be facilitated by means of an electromechanical device disclosed in the U.S. Pat. No. 5,916,085. The known electromechanical device comprises a plank-like person support member rotatably mounted on a frame positioned beside a bed. A patient, sitting or lying on the bed, uses a controller to rotate himself on the person support member about his sagittal axis, wherein said patient is fully and permanently supported by the plank-like person support member. Although the known device facilitates rotation of a patient, the known devise also has several drawbacks. A first drawback of the known device is that the known electromechanical device is relatively robust, and hence hardly transportable. Moreover, the known device is relatively expensive due to an assembly of electromechanical components to be able to displace the person. Another major drawback of the known device is that the patient is forced to undergo a stiff (plank-like) rotation, and hence to undergo an unnatural curve. No active attitude of the patient is expected and required during sagittal rotation. It has been found that this stiff (plank-like) movement will easily cause pain complaints, in particular near the lower ribs. Moreover, this stiff movement will passivate the patient even further, and will counteract recovery of the patient which could even lead to regression of the state of health of the patient.

The invention has for its object to provide a relatively user-friendly apparatus for displacing a person from a recumbent position to a sitting position and vice versa.

SUMMARY OF THE INVENTION

The invention provides for this purpose an apparatus for displacing a person from a lateral recumbent position to a sitting position and vice versa, characterized in that the engaging means are coupled to force-transmitting means rotatable about the substantially horizontal axis, said force-transmitting means being adapted to roll along a surface supporting the person. By rolling the device along the supporting surface the horizontal axis will be displaced during rotation of the patient, while the sagittal axis of the patient will remain at more or less the same position, the latter movement being in accordance with methods recommended by physiotherapists to stimulate recovery. By causing the substantially horizontal axis to displace during rotation of the engaging means, the engaging means will pass through a non-circular path during displacement. Such a (non-circular) curved path can be advantageous in enabling displacement of the user in a less fixated, more natural and relatively fluent manner. Moreover, the device according to the invention may constructively be relatively simple and compact and therefore relatively inexpensive and easily transportable. An additional advantage of the device according to the invention is that re-activation, and hence recovery of the patient will be stimulated by using the device, since a (moderate) active attitude of the patient is expected and required during sagittal rotation, thereby forcing the patient slightly to use one or more muscle groups for a short period of time. The force-transmitting means can be formed for instance by a (partly) curved bracket which is adapted to support on the support surface while rolling along the support surface during rotation of the engaging means about the substantially horizontal axis. A lever effect can thus be realized during displacement of the user. The positioning of the substantially horizontal axis will generally be determined here by the relative orientation between the support surface and the force-transmitting means, in particular the (partly) curved bracket, and generally lies on the support surface of the person. In another particular preferred embodiment, the force-transmitting means are pivotable about the substantially horizontal axis. Thus, in the case the substantially horizontal axis is formed by a physical shaft, a torque of the substantially horizontal axis can for instance be usefully employed, by means of the force-transmitting means, for the rotation of the engaging means, and thus of the person.

As mentioned above the rotation about a sagittal axis of the user can be realized because the engaging means are rotatable about the substantially horizontal axis. Such a movement, which the (semi-invalid) user undergoes during use of the apparatus, is very similar to methods of getting in and out of bed recommended by physiotherapists, wherein the load on the body, and in particular the back, neck and shoulders, is minimized. During use of the apparatus according to the invention the user thus rotates here (substantially) only on a single (natural) sagittal axis generally located at the position of the lower trunk, and not, as occurs during use of the already known apparatus, on a dual axis where the user rotates about both a transverse axis and a longitudinal axis of the user. It is noted that during rotation on the sagittal axis the user can rotate as a whole and can also undergo a lower trunk rotation. The at least substantially horizontal rotation axis of the engaging means can be formed by a physical shaft, but may also be formed by a notional (imaginary) axis. The positioning of the at least substantially horizontal axis relative to the person can also be varied; the axis can be located substantially under the person, but may intersect the person or be located substantially above the person, as long as rotation of the engaging means about this horizontal axis brings about a sagittal rotation of the user.

In a preferred embodiment the engaging means are provided with a head support and/or a first handgrip for the person. In the case a support (such as a head support, back support, shoulder support and/or neck support) is applied, the user is then displaced in supporting manner during the rotation about the sagittal axis. As will be apparent, diverse body parts of the user, such as the head, neck, shoulders, back etc., can be supported during displacement of the user. The user does not therefore need to actively hold onto the engaging means, but is displaced in (almost) passive manner from a lateral recumbent position to a sitting position, and vice versa. It is on the other hand also possible to provide the engaging means with a handgrip or any other holding member onto which the user can hold in order to undergo the sagittal rotation.

The force-transmitting means can herein be very diverse in nature, design and dimensioning. The purpose of the force-transmitting means is to transmit the forces exerted on the apparatus to the engaging means in order to enable the engaging means to rotate about the substantially horizontal axis. The loads exerted on the apparatus, and particularly on the force-transmitting means, can be applied using for instance muscular force and/or (electro)mechanical force or any other external energy source. The force-transmitting means can herein be formed for instance by one or more arms, by one or more (mutually co-acting) toothed wheels, and/or by one or more assemblies of a pulley and a cord co-acting therewith.

In a further particular preferred embodiment, the force-transmitting means are provided with at least a second handgrip for exerting a manual force on the apparatus by a second person to bring about rotation of the engaging means. By applying muscular force on the second handgrip, the second person, generally a caregiver, can cause the engaging means to rotate about the substantially horizontal axis via the force-transmitting means, whereby the user will undergo the rotation about the substantially sagittal axis. The second handgrip can optionally be formed by an operating handle of an electric motor connected to the force-transmitting means. The substantially horizontal axis is preferably located between the engaging means and at least a second handgrip. By positioning the pivot point between the two physically loaded elements, i.e. the engaging means on one side and the second handgrip on the other, a lever effect can be achieved during displacement of the user from a lateral recumbent position to a sitting position and vice versa. The user can hereby be displaced in relatively simple, easy and efficient manner between a sitting position and a lateral recumbent position. It is however also possible to position the at least one second handgrip adjacently of the engaging means. The second handgrip can thus (also) be arranged on for instance the head support. It will be apparent that it is also possible to envisage applying a plurality of second handgrips in the same apparatus according to the invention, in order to further facilitate displacement of the engaging means.

In another preferred embodiment, the force-transmitting means are coupled to electromechanical drive means for rotating the engaging means. The electromechanical drive means can herein be formed for instance by one or more electric motors. The electromechanical drive means can optionally be activated unassisted by the user, whereby the user can cause the engaging means, and thus him/herself, to rotate relatively simply and wholly autonomously. Such an activation can herein be arranged for instance on the engaging means.

The force-transmitting means are preferably at least partially adapted to support the person. The force-transmitting means can in that case be provided with one or more (optionally) curved arms for supporting at least a part of the user. In this way the dorsally located contact surface between the user and the force-transmitting means can be enlarged, whereby displacement of the user can take place in more controlled, stable and smooth manner.

In yet another preferred embodiment, the substantially horizontal axis is displaceable. As already noted, the force-transmitting means are preferably also provided with at least one arm. In a further preferred embodiment, the arm takes an at least partially non-linear form, wherein a part of the arm takes an angular or curved (bracket-like) form.

The invention also relates to a bed provided with such an apparatus. The bed is preferably mobile in that the bed is provided with a plurality of carrying wheels.

The invention further relates to a method for displacing a person from a lateral recumbent position to a sitting position, and vice versa, using such an apparatus, comprising the steps of: A) causing the engaging means to engage on the person, and B) causing the engaging means to rotate about the substantially horizontal axis, wherein the person undergoes a rotation about the sagittal axis from a lateral recumbent position to a sitting position. The advantage of applying the method according to the invention is that the user undergoes a natural displacement about the sagittal axis, wherein the loads exerted on the user are minimized. Further advantages have already been described in the foregoing. The rotation of the engaging means as according to step B) preferably takes place in manual manner by applying muscular force directly or indirectly to the engaging means. In another preferred embodiment the rotation of the engaging means as according to step B) takes place in electromechanical manner, for instance by means of an electric motor. In a further preferred embodiment the substantially horizontal axis is displaced during rotation of the engaging means as according to step B). Advantages of the above stated preferred embodiments have already been described above.

BRIEF DESCRIPTION OF THE DRAWINGS

The invention will be further elucidated on the bases of non-limitative exemplary embodiments shown in the following figures, in which.

DETAILED DESCRIPTION OF THE PREFERRED EMBODIMENTS

Figure 1:
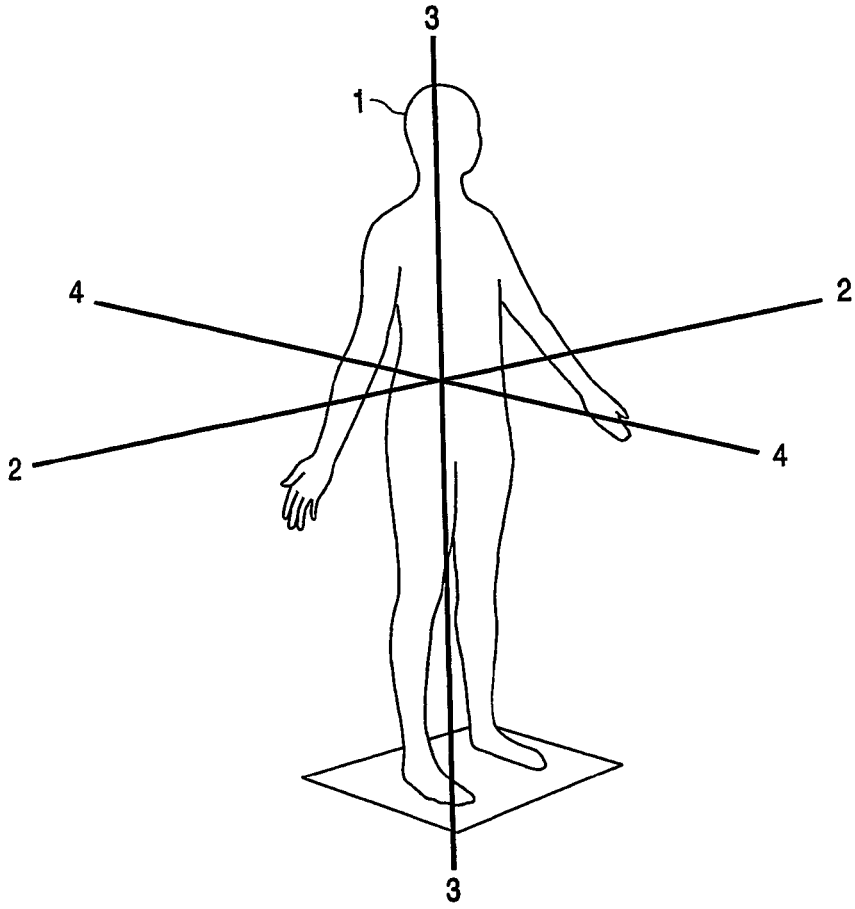
FIG. 1 shows a perspective view of a person, wherein diverse anatomical axes are indicated.

FIG. 1 shows a perspective view of a person 1, wherein diverse general anatomical axes 2, 3, 4 are indicated. Every human body 1 has one (or more) transverse axes 2 which intersect both a left-hand part and a right-hand part of the body, in this example horizontally. In addition, the human body has one (or more) longitudinal axes 3 which extend over the length of the body 1. In addition to the transverse axis 2 and longitudinal axis 3, the human body 1 also has one (or more) sagittal axes 4 which intersect both a front part and a rear part of the human body 1, in this example horizontally.

Figure 2:
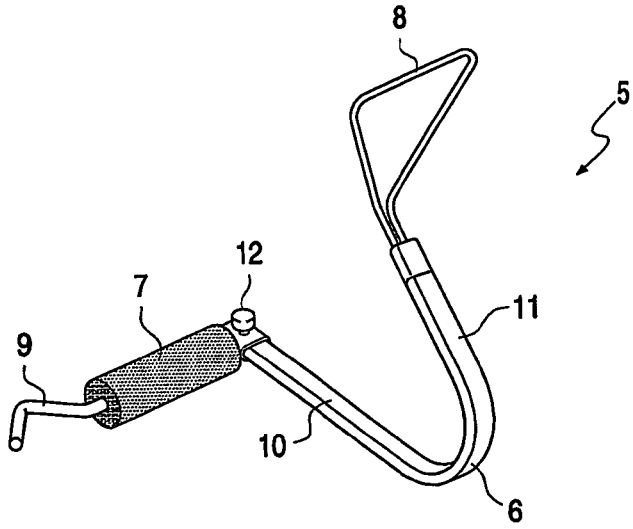
FIG. 2 shows a perspective view of a preferred embodiment of an apparatus according to the invention.

FIG. 2 shows a perspective view of a preferred embodiment of an apparatus 5 according to the invention. The (mobile) apparatus 5 comprises a bracket-like arm 6, which arm 6 is provided on one side with a head support 7 for supporting a user (not shown), and which arm 6 is provided on an opposite aide with a handgrip 8 for a caregiver (not shown). Handgrip 8 is arranged to facilitate displacement of the user between a lateral recumbent position and a sitting position. Head support 7 is connected on a side remote from arm 6 to an additional handgrip 9 for the caregiver, in order to further facilitate displacement of the user. Arm 6 is in fact constructed from an upper arm part 10 located toward head support 7, and a lower arm part 11 located toward handgrip 8. Both arm parts 10, 11 are mutually connected at the position of a curve in both arm parts 10, 11.

The curve is here adapted to support, in particular roll along, on a surface supporting the user. The length of upper arm part 10 substantially corresponds to the distance between the neck or the head of the user on the one hand and the (lower part of the) trunk or seat of the user on the other. The effective length of upper arm part 10 is adjustable by sliding head support 7 along upper arm part 10. When the correct arm length is obtained, the relative orientation between head support 7 and arm 6 can be fixed by means of a locking element 12. The length of lower arm part 11 is particularly relevant for optimizing the lever action for the caregiver during rotation—by rolling along on the support surface—of apparatus 5, in particular head support 7. Arm 6 is preferably manufactured from a substantially rigid material, such as for instance aluminum or any other metal. Conversely, head support 7 is preferably manufactured from a (slightly) elastic material, such as for instance foam rubber, so as to make supporting on head support 7 more pleasant for the user. In addition to a relatively flexible applicability of the mobile apparatus 5, apparatus 5 has the advantage of being structurally relatively simple. The further operation of the shown apparatus 5 is shown in FIGS. 3*a*, 3*b* and 3*c*.

Figure 3A:
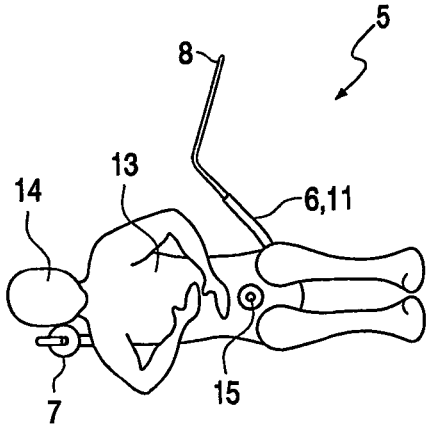
FIG. 3*a* shows a schematic view of the apparatus of FIG. 2 and a person in a lateral recumbent position.

FIG. 3*a* shows a schematic view of apparatus 5 of FIG. 2 and a person 13 in a lateral recumbent position. The head 14 of person 13 supports on head support 7. Arm 6 is positioned along person 13 on a dorsal side of person 13, wherein lower arm part 11 of arm 6 protrudes relative to a lateral side of person 13. Arm 6 herein supports on a support surface (not shown) of person 13. Another person, for instance a caregiver, can displace handgrip 8 in the direction of the support surface, wherein head support 7 will be displaced in a direction away from the support surface, as shown in FIGS. 3*b* and 3*c*. During displacement of head support 7 in said direction, person 13 will undergo a rotation on his/her own sagittal axis 15 at the position of the lower trunk, this sagittal axis being indicated here.

Figure 3B:
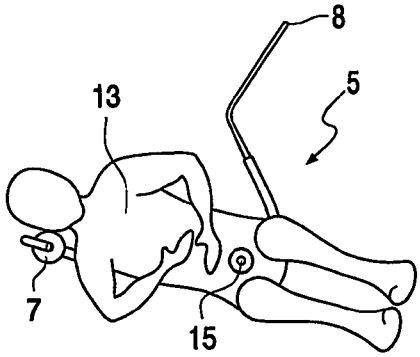
FIG. 3*b* shows a schematic view of the apparatus of FIG. 2 and a person in a transition position.

FIG. 3*b* shows a schematic view of apparatus 5 of FIG. 2 and person 13 in a transition position. Since only a rotation on the sagittal axis 15 of person 13 takes place, wherein person 13 is supported at a distance from sagittal axis 15 by head support 7, a user-friendly and controlled rotation of person 13 can take place, wherein the loads exerted on person 13 are minimized. If handgrip 8 is displaced further in the direction of the support surface by the other person, in particular the caregiver, further rotation of person 13 about the sagittal axis 15 can take place. A position which can then be reached is the sitting position of person 13 as shown in FIG. 3*c*.

Figure 3C:
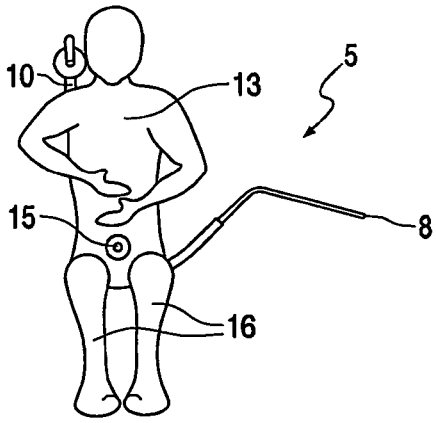
FIG. 3*c* shows a schematic view of the apparatus of FIG. 2 and a person in a sitting position.

FIG. 3*c* shows a schematic view of apparatus 5 of FIG. 2 and the person 13 in a sitting position, wherein the legs 16 of the person are oriented along the support surface. In the shown situation the upper arm part 10 is in substantially vertical orientation, and handgrip 8 is positioned close to the support surface. The person 13 can stand up relatively easy in the shown position, and apparatus 5 can also be easily removed from the support surface and person 13. It should be noted that the relative orientation between the sagittal axis 15 and the person 13 has not changed, or at least hardly so, during the displacement of person 13. It will be apparent that, as well as being used to displace person 13 from the lateral recumbent position to the sitting position, the shown apparatus 5 can also be used to displace person 13 from the sitting position to the lateral recumbent position.

Figure 4:
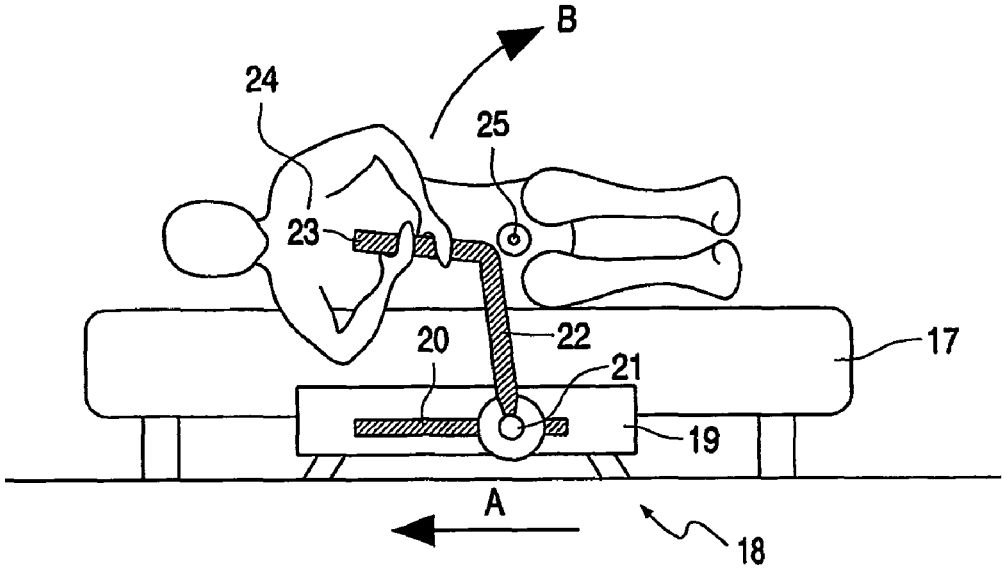
FIG. 4 is a side view of a bed provided with another apparatus according to the invention.

FIG. 4 is a side view of a bed 17 provided with another apparatus 18 according to the invention. A substantial part of apparatus 18 is here positioned under bed 17. Apparatus 18 is provided with a housing 19 for an electric motor (not shown), wherein housing 19 is provided with a slot 20 for passage of a substantially horizontal rotatable shaft 21. The rotatable shaft 21 is herein displaceable through slot 20, preferably during rotation of shaft 21. The rotatable shaft 21 is coupled to an angular arm 22, wherein a part of the arm 22 remote from rotation shaft 21 functions as engaging element 23 for a, preferably lateral recumbent, person 24 positioned on bed 17. After activation of the electric motor by person 24 or by another person, rotation shaft 21 will begin to rotate in clockwise direction, wherein the rotating shaft 21 will also be displaced horizontally through slot 20 (see arrow A). As a result the engaging element 23 will describe a curved (non-circular) path in clockwise direction. The person 24 holding onto engaging element 23 will undergo a natural rotation on a sagittal axis 25 of person 24 (see arrow B) in the direction of a sitting position. Since rotation shaft 21 is displaced horizontally in the direction of arrow A during rotation, the user can be displaced in natural, unforced manner from a recumbent position to a sitting position (and vice versa). Owing to the horizontal displacement of rotation shaft 21 leg room is furthermore created for person 24 during displacement of person 24 in the direction of the sitting position. Apparatus 18 can be permanently connected to bed 17, but can also be embodied as a releasable module which can be fitted to a conventional bed.

Figure 5:
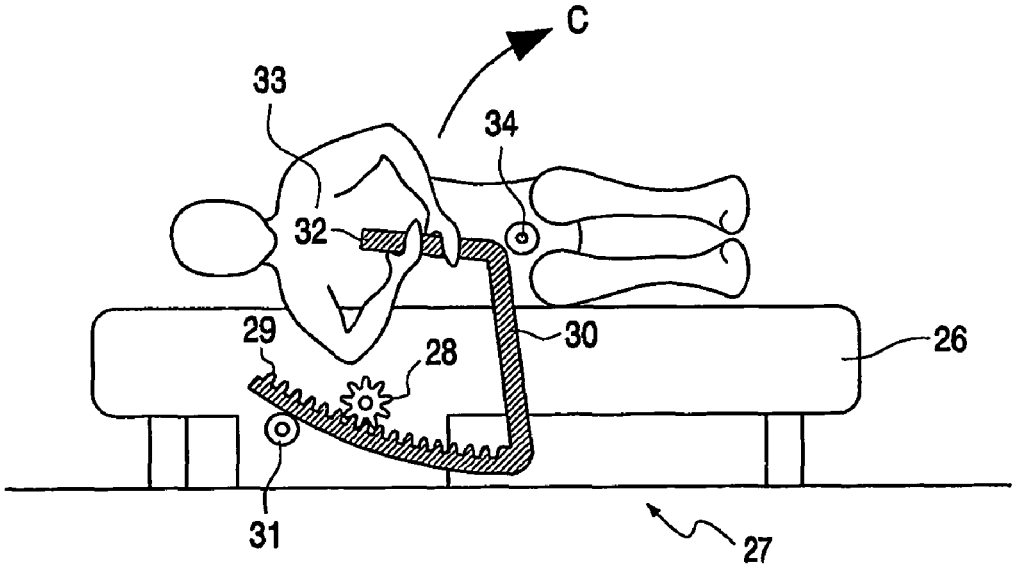
FIG. 5 is a side view of a bed provided with yet another apparatus according to the invention.

FIG. 5 is a side view of a bed 26 provided with yet another apparatus 27 according to the invention. Apparatus 27 greatly resembles the apparatus 18 shown in FIG. 4. Apparatus 27, which is positioned for the greater part under bed 26, comprises a rotatable toothed wheel 28 driven by an electric motor (not shown). Toothed wheel 28 is adapted for co-action with a toothed surface 29 of a non-linear arm 30. A side of arm 30 remote from the toothed surface 29 is supported in a guiding manner by a support wheel 31. A part of arm 30 protruding above bed 26 is adapted as handgrip 32 for a user 33 situated on bed 26. When toothed wheel 28 is rotated, arm 30 will begin to displace, wherein handgrip 32 will begin to rotate on an imaginary axis such that the user 33 holding onto handgrip 32 will be rotated about the substantially sagittal axis 34 of user 33 to a sitting position (arrow C). The lower trunk rotation or whole body rotation of user 33 on the sagittal axis minimizes the load of the body of user 33, and is therefore generally very suitable for semi-invalid users 33. The shown apparatus 27 can be used wholly autonomously by user 33, wherein assistance from a caregiver or other person is not essential.

It will be apparent that the invention is not limited to the exemplary embodiments shown and described here, but that within the scope of the appended claims a large number of variants are possible which will be self-evident to the skilled person in this field.

The invention claimed is:

1. An apparatus for displacing a person from a lateral recumbent position to a sitting position and vice versa, comprising:

an engaging means for engaging the person, the engaging means being rotatable about a substantially horizontal axis such that, during rotation of the engaging means while engaging the person, the person undergoes a rotation about a substantially sagittal axis of the person from the lateral recumbent position to a sitting position and vice versa; and a force-transmitting means coupled to the engaging means and rotatable about the substantially horizontal axis, said force-transmitting means comprising at least one non-linear arm being adapted to roll along a surface supporting the person.

2. The apparatus as claimed in claim 1, wherein the engaging means are provided with a head support and/or a first hand grip.

3. The apparatus as claimed in claim 1, wherein the force-transmitting means are pivotable about the substantially horizontal axis.

4. The apparatus as claimed in claim 1, wherein the force-transmitting means are provided with at least a second handgrip for exerting a manual force on the apparatus by a second person to bring about rotation of the engaging means.

5. The apparatus as claimed in claim 4, wherein the substantially horizontal axis is located between the engaging means and at least a second handgrip.

6. The apparatus as claimed in claim 4, wherein at least a second handgrip is positioned adjacently of the engaging means.

7. The apparatus as claimed in claim 1, wherein the force-transmitting means are coupled to electromechanical drive means for rotating the engaging means.

8. The apparatus as claimed in claim 1, wherein the force-transmitting means are at least partially adapted to support the person.

9. The apparatus as claimed in claim 1, wherein the force-transmitting means are at least partially bracket-shaped.

10. The apparatus as claimed in claim 1, wherein the substantially horizontal axis is displaceable.

11. A bed provided with an apparatus as claimed in claim 1.

12. The bed as claimed in claim 11, wherein the bed is mobile.

13. A method for displacing a person from a lateral recumbent position to a sitting position, and vice versa comprising the steps of:

A) providing an apparatus comprising:

an engaging means for engaging the person, the engaging means being rotatable about a substantially horizontal axis; and a force-transmitting means coupled to the engaging means and rotatable about the substantially horizontal axis, said force-transmitting means comprising at least one non-linear arm being adapted to roll along a surface supporting the person, B) causing the engaging means to engage the person, and C) causing the engaging means to rotate about the substantially horizontal axis, wherein the person undergoes a rotation about the sagittal axis from a lateral recumbent position to a sitting position, wherein the substantially horizontal axis is displaced during rotation of the engaging means.

14. The method as claimed in claim 13, wherein the rotation of the engaging means takes place in manual manner.

15. The method as claimed in claim 13, wherein the rotation of the engaging means takes place in an electromechanical manner.

* * * * *